US011700878B2

(12) United States Patent
Newman et al.

(10) Patent No.: US 11,700,878 B2
(45) Date of Patent: Jul. 18, 2023

(54) MODULAR CIGAR

(71) Applicant: BROTHERS BROADLEAF LLC, Tampa, FL (US)

(72) Inventors: Robert Paxton Newman, Tampa, FL (US); Charles Dawson Newman, Tampa, FL (US)

(73) Assignee: Brothers Broadleaf LLC

( * ) Notice: Subject to any disclaimer, the term of this patent is extended or adjusted under 35 U.S.C. 154(b) by 117 days.

(21) Appl. No.: 17/237,528

(22) Filed: Apr. 22, 2021

(65) Prior Publication Data

US 2022/0338531 A1 Oct. 27, 2022

(51) Int. Cl.
*A24D 1/02* (2006.01)
*A24C 1/32* (2006.01)
*A24C 1/26* (2006.01)

(52) U.S. Cl.
CPC ..... *A24D 1/02* (2013.01); *A24C 1/26* (2013.01); *A24C 1/32* (2013.01)

(58) Field of Classification Search
CPC ..... A24D 1/02; A24C 1/32; A24C 1/26
USPC ..... 131/365
See application file for complete search history.

(56) References Cited

U.S. PATENT DOCUMENTS

| | | | | |
|---|---|---|---|---|
| 829,296 | A * | 8/1906 | Rosales | A24D 1/042 131/361 |
| 8,056,566 | B2 | 11/2011 | Kang et al. | |
| 8,464,727 | B1 | 6/2013 | Sinclair, Jr. | |
| 10,226,069 | B1 | 3/2019 | Sinclair, Jr. | |
| 2003/0217757 | A1 | 11/2003 | Edelmann | |
| 2005/0121341 | A1 | 6/2005 | Darwish | |
| 2011/0094525 | A1 | 4/2011 | Maal | |
| 2014/0360519 | A1 | 12/2014 | George et al. | |
| 2020/0337365 | A1 | 10/2020 | Mendoza et al. | |

OTHER PUBLICATIONS

"Smoke Pearls"; May 10, 2021; downloaded from https://smokepearls.com/.

* cited by examiner

*Primary Examiner* — Michael J Felton
*Assistant Examiner* — Ronnie Kirby Jordan
(74) *Attorney, Agent, or Firm* — Barnes & Thornburg LLP

(57) ABSTRACT

A modular cigar and methods are provided for assembling and use of the modular cigar. The modular cigar includes an inner bound module, removable end cap, and removable outer wrapper. The removable outer wrapper is coupled with the inner bound module in an adhesive-free manner.

13 Claims, 5 Drawing Sheets

MODULAR CIGAR

BACKGROUND

The present disclosure relates to systems, components, and methodologies for making and using a cigar. In particular, the present disclosure relates to systems, components, and methodologies for making and using a modular cigar.

SUMMARY

According to the present disclosure, a modular cigar is provided that uses no adhesive in assembly of an inner bound module with an outer wrapper and removable cap.

In accordance with at least one embodiment, the modular cigar includes a removable end cap, an inner bound module including a filler, and a outer wrapper leaf with a main vein extending longitudinally along a length of the wrapper leaf, wherein in the rolled position coupled to the inner bound module, the main vein extends in parallel to a longitudinal axis of the modular cigar to form an adhesive-free coupling to the inner bound module.

In accordance with some embodiments, the outer binder leaf is formed as a parallelogram, and the longitudinally extending main vein intersects only two ends of the parallelogram transverse to the length of the wrapper leaf. The outer binder leaf may be unrolled from the inner bound module and rolled around a different inner bound module. In some embodiments a removable end cap is coupled to one end of the modular cigar around the outer wrapper to maintain the outer wrapper means securely in the rolled position around the inner bound module.

Additional features of the present disclosure will become apparent to those skilled in the art upon consideration of illustrative embodiments exemplifying the best mode of carrying out the disclosure as presently perceived.

BRIEF DESCRIPTION OF THE FIGURES

The detailed description particularly refers to the accompanying figures in which.

DETAILED DESCRIPTION OF THE FIGURES

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

Figure 1:
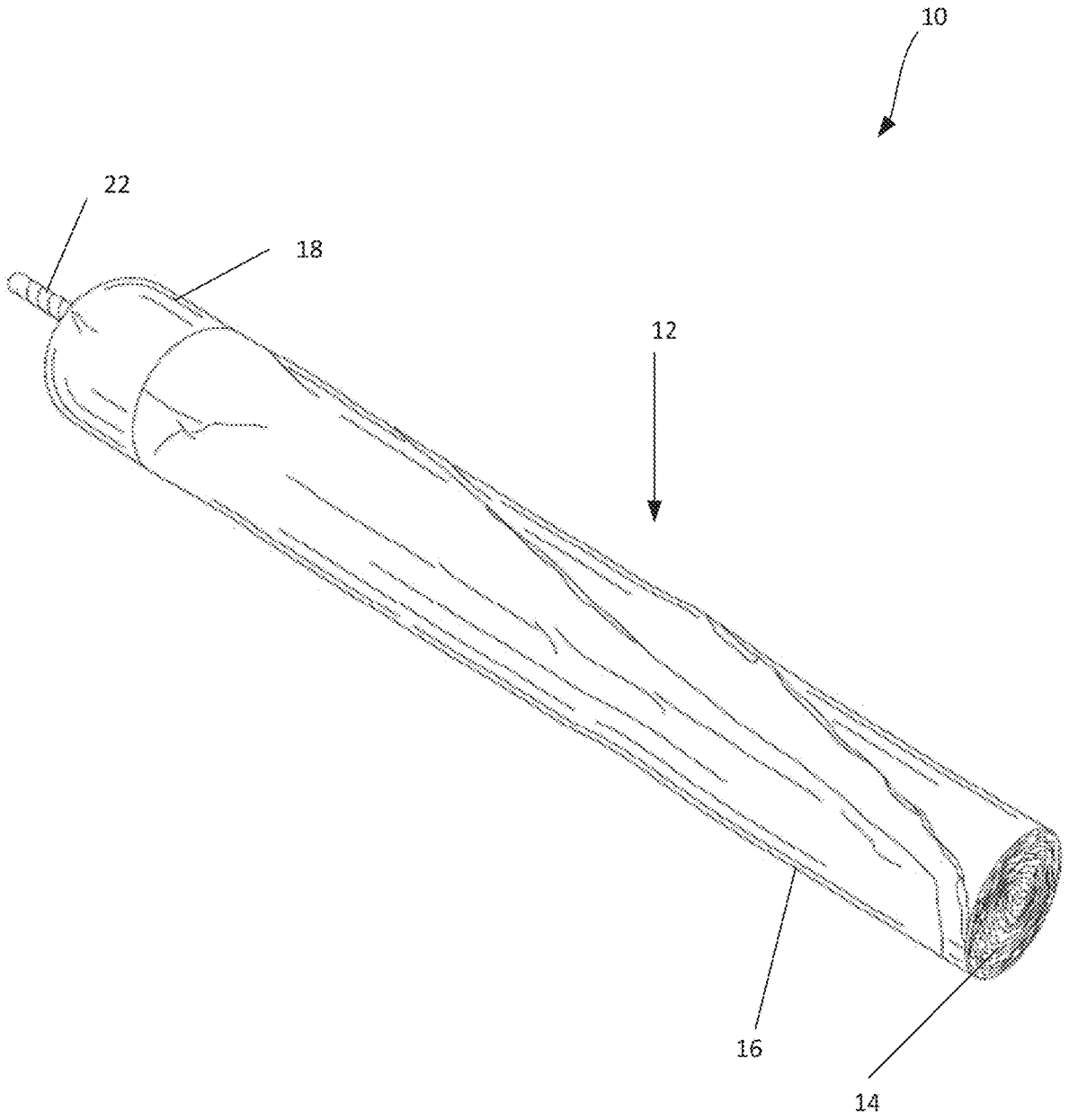
FIG. 1 is a perspective view illustrating an assembled modular cigar according to a disclosed embodiment.

FIG. 1 illustrates a modular cigar, in particular a modular cigar 10 including a cigar body 12 formed by an inner bound module 14, and an outer wrapper 16 surrounding the inner bound module 14. One end of the cigar body may include a removable end cap 18. According to FIG. 1, the inner bound module 14 includes a filler 20. The removable end cap 18 has a narrow distal end 22 formed by twisting the cap material, which may be grasped to remove end cap 18 from the cigar body 12.

Figure 2:
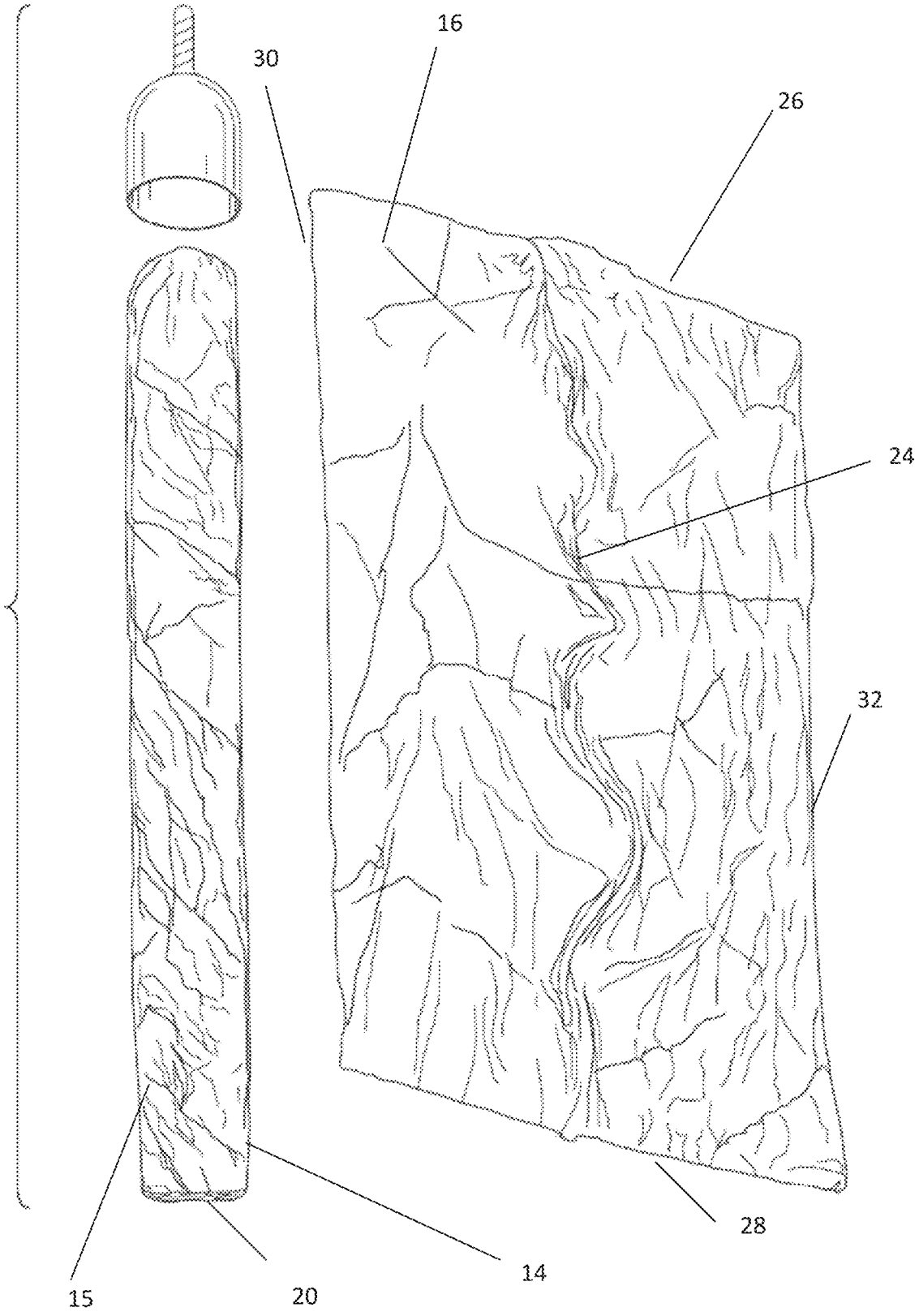
FIG. 2 illustrates the components that form the modular cigar in accordance with the disclosed embodiment of FIG. 1.
Figure 5:
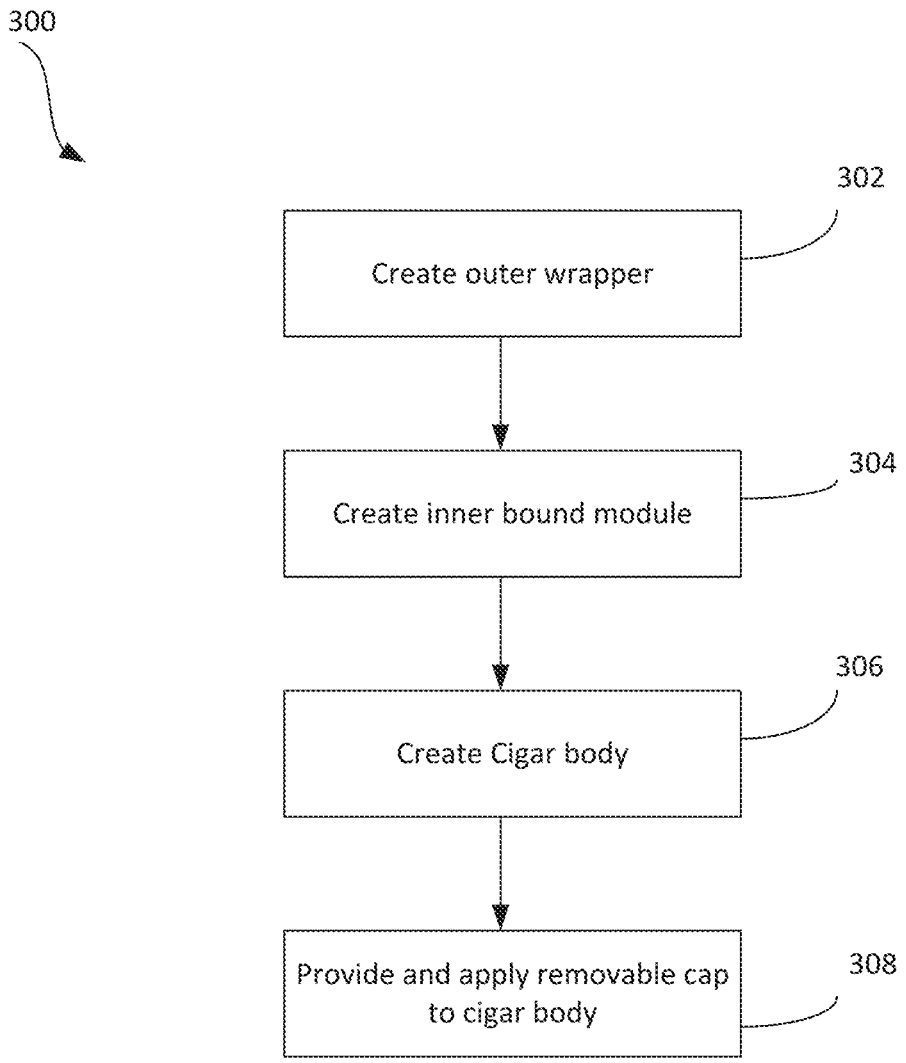
FIG. 5 is a diagrammatic flow chart of a method of assembling a modular cigar in accordance with the disclosed embodiments.

As illustrated in FIG. 2, the outer wrapper 16 is removably coupled to the inner bound module 14. When the outer wrapper 16 is decoupled from the inner bound module 14, the inner bound module 14 remains intact via a binder 15 that contains the filler 20. Outer wrapper 16 is formed from a leaf and includes a longitudinally extending main vein 24. The leaf is cut so that outer wrapper 16 is in the form of a parallelogram as illustrated, with the main vein 24 extending the length of the outer wrapper 16. The leaf may be cut to form a parallelogram having relatively longer longitudinally extending sides 30, 32 intersecting relatively shorter ends 26, 28 transverse to the main length of the outer wrapper. The leaf is cut so that the main vein 24 does not intersect either of the longitudinal sides 30, 32 of the outer wrapper 16, thereby rendering the outer wrapper 16 predisposed to curl in on itself with longitudinally sides 30, 32 curling in towards each other. In this manner, the outer wrapper 16 is predisposed to curling in the direction that it is rolled around the inner bound module 14 and biased towards the rolled position. Therefore, as illustrated in FIG. 2 and further discussed with respect to FIG. 5, the outer wrapper 16 may be secured, removed, and re-secured to inner bound module 14 or even another different inner bound module without the use of any adhesive.

Figure 3:
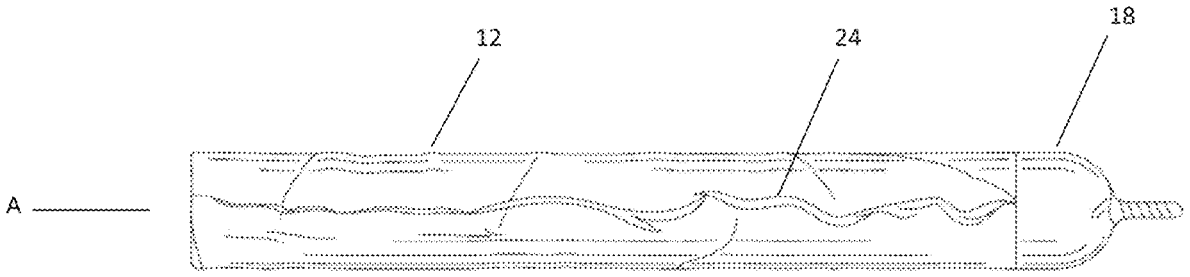
FIG. 3 is a side view of the assembled modular cigar according to the disclosed embodiment.
Figure 4:
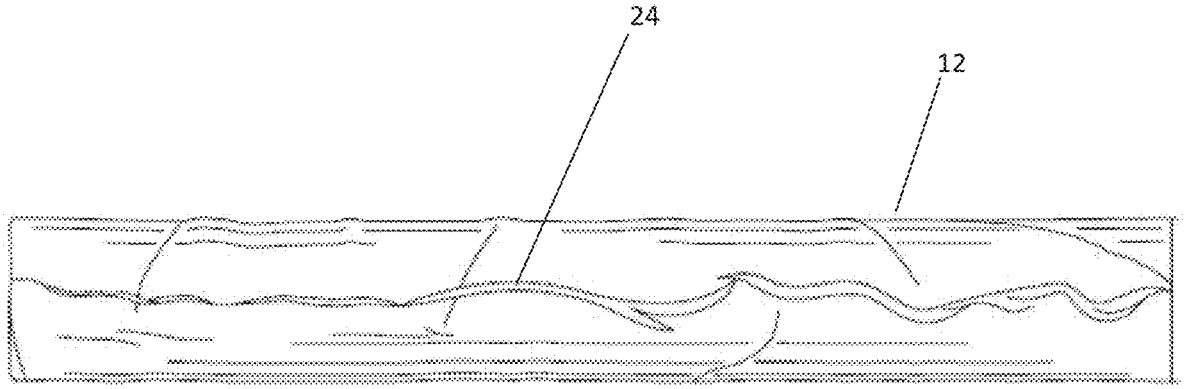
FIG. 4 is a view of the assembled modular cigar in the use configuration according to the disclosed embodiment.

FIG. 3 illustrates the assembled modular cigar with the main vein 24 extending longitudinally along the cigar body 12 and parallel to a central axis-A of the cigar body. FIG. 4 shows the cigar body 12 with the end cap 18 of FIGS. 1-2 removed. The end cap 18 may be removed by a pulling and/or twisting motion. Additionally, the endcap 18, may be moistened to facilitate removal and reuse. In this illustrated configuration, the modular cigar is ready to be smoked, or for the outer wrapper 16 to be decoupled from the inner bound module 14 by unrolling the outer wrapper 16 without damage to either the outer wrapper 16 or the inner bound module 14 due to the adhesive-less coupling. Outer wrapper 16, may be rolled around another inner bound module (not shown) to form a new cigar body. End cap 18, may be untwisted to form a flat sheet and used to repair, patch, or enhance outer wrapper 16 when rolling around another inner bound module.

In a method of making the modular cigar 300 as disclosed in the above embodiments, an outer wrapper is created for the cigar 302. This outer wrapper is formed from a single leaf with a main vein. The leaf may be aged for 8 months to darken and thicken the leaf. The leaf may be selected from relatively thick leaves such as a Connecticut Broadleaf or an Ecuadorian Havana. The leaf is cut so that the main vein extends longitudinally along the length of the cut outer wrapper. The outer wrapper is cut to form parallelogram to bias the longitudinally extending sides of the wrapper to curl or curve towards each other while the main vein intersects only the transverse shorter ends of the parallelogram. By using a single leaf, this curling biase can be leveraged to roll the cigar and avoid the use of adhesive. The outer wrapper may be cut by hand and/or be cut using a stencil to form the parallelogram.

An inner bound module is created for the cigar 304 so that the filler that is formed of the smokeable component is contained. The smokeable component may be any loose smokeable filler including but not limited to tobacco. The binder may be selected from any tobacco leaves, which is relatively thinner compared to the outer wrapper leaf. The binder may bind the loose filler by being rolled to surround the loose filler. The binder leaf may be sealed around the loose filler using an adhesive to provide a mess-free inner bound module. For example, a Lieberman tool may be used to roll the wrapper around the filler.

A cigar body is created 306 by coupling the outer wrapper to the inner bound module. This may be done by moistening the wrapper to make it pliable and rolling the wrapper around the inner bound component, for example, by hand. Once the wrapper has been rolled around the inner bound component, the rolled body may be placed in a cigar mold, having a cylindrical shape to match the shape of the cigar body so that the wrapper rolled around the inner bound component will dry to and maintain a consistent cylindrical shape without the use of any adhesives. The cigar body may be placed in the mold so that one end of the cigar body extends outside of the mold. The length of the cigar extending outside the mold is less than 1.5 inches.

A removable cap is provided and applied to the dried stiffened cigar body 308. The cap may applied by rolling a cap leaf around end of the cigar exposed outside the mold and then twisting the free end of the cap leaf not touching the cigar body to enclose the end of the cap. The cap can be made from a leaf such as a Connecticut shade tobacco leaf. The fully assembled modular cigar may then be removed from the mold 310.

Although the disclosed modular cigar includes the removable endcap, it is also possible that other endcaps or bands may be used to maintain the integrity of the assembled cigar during packaging and transit. Further, it is possible that the particularly cut outer wrappers can be packaged decoupled from and/or along with a plurality of inner bound components as a kit to permit assembly of the cigar body by the consumer by rolling the biased outer wrappers.

Although certain embodiments have been described and illustrated in exemplary forms with a certain degree of particularity, it is noted that the description and illustrations have been made by way of example only. Numerous changes in the details of construction, combination, and arrangement of parts and operations may be made. Accordingly, such changes are intended to be included within the scope of the disclosure, the protected scope of which is defined by the claims.

The invention claimed is:

1. A modular cigar comprising:

a removable end cap;

an inner bound module including a filler enclosed in a binder leaf to secure the loose filler; and an outer wrapper means for repeatedly coupling and decoupling with the outside of the inner bound module by unrolling and rerolling without damage to the outer wrapper means, which is biased to a rolled position, so that the outer wrapper means creates an adhesive-free coupling with the inner filler module, wherein the outer wrapper means comprises a wrapper leaf with a main vein extending longitudinally along a length of the wrapper leaf, wherein in the rolled position coupled to the inner bound module, the main vein extends in parallel to a longitudinal axis of the modular cigar.

2. The modular cigar of claim 1, wherein the wrapper leaf is formed in a parallelogram shape, wherein the longitudinally extending main vein intersects only two ends of the parallelogram transverse to the length of the wrapper leaf.

3. The modular cigar of claim 1, wherein the wrapper leaf is configured to decouple from the outside of the inner bound module, while the inner bound module remains intact.

4. The modular cigar of claim 3, wherein two longitudinal sides of the wrapper leaf free of intersection of the longitudinally extending main vein curve inwardly towards each other in a decoupled, non-stressed position.

5. The modular cigar of claim 1, wherein the removable end cap is configured to be coupled to one end of the modular cigar around the outer wrapper means to maintain the outer wrapper means in the rolled position around the inner bound module, and wherein removal of the end cap releases the outer wrapper damage-free unrolling of the outer wrapper.

6. The modular cigar of claim 1, wherein the binder leaf is thinner than the wrapper means, and the removable end cap is configured to be unrolled and used as a patching piece.

7. A method for making a module cigar comprising:

creating an inner bound module including a loose filler enclosed in a binder leaf to secure the loose filler;

creating an outer wrapper that is predisposed to be in a rolled position for repeatedly coupling and decoupling, without damage to the outer wrapper, with the outside of the inner bound module by unrolling and rerolling the outer wrapper to form an adhesive-free coupling; and providing a removable end cap, wherein the outer wrapper comprises a wrapper leaf with a main vein extending longitudinally along a length of the wrapper leaf, wherein in the rolled position coupled to the inner bound module, the main vein extends in parallel to a longitudinal axis of the modular cigar.

8. The method of claim 7, wherein creating the outer wrapper comprises cutting a leaf in a shape of a parallelogram, wherein the leaf is cut to provide the main leaf vein extending longitudinally along a length of the wrapper leaf.

9. The method of claim 7, wherein the leaf is cut so the longitudinally extending main vein intersects only two ends of the parallelogram transverse to the length of the wrapper leaf.

10. The method of claim 7, further comprising moistening the outer wrapper, rolling it around the inner bound module to form a cigar body, so that the longitudinally extending main vein extends parallel to a central longitudinal axis of the cigar body.

11. The method of claim 10, comprising placing the cigar body in a cigar mold with a tip of the cigar extending out of the end of the mold to form an adhesive-free coupling between the inner bound module and the outer wrapper.

12. The method of 11, further comprising drying the cigar body in the cigar mold, moistening the removable end cap, and coupling the removable end cap to the tip of the cigar body extending out of the end of the mold.

13. The method of claim 7, wherein the binder leaf is relatively thinner than the outer wrapper.

* * * * *